US007421913B2

(12) United States Patent
Belgardt et al.

(10) Patent No.: US 7,421,913 B2
(45) Date of Patent: Sep. 9, 2008

(54) PIPETTE

(75) Inventors: Herbert Belgardt, Paulinenallee (DE); Peter Molitor, Henstedt-Ulzburg (DE); Bernd Jagdhuber, Uetersen (DE)

(73) Assignee: Eppendorf AG, Hamburg (DE)

( * ) Notice: Subject to any disclaimer, the term of this patent is extended or adjusted under 35 U.S.C. 154(b) by 197 days.

(21) Appl. No.: 11/111,206

(22) Filed: Apr. 21, 2005

(65) Prior Publication Data

US 2005/0247141 A1 Nov. 10, 2005

(30) Foreign Application Priority Data

May 6, 2004 (DE) ..... 10 2004 022 419

(51) Int. Cl.
*B01L 3/02* (2006.01)

(52) U.S. Cl. ..... 73/864.13

(58) Field of Classification Search ..... 73/864.11, 73/864.13, 864.16, 864.18; 422/100; 436/180
See application file for complete search history.

(56) References Cited

U.S. PATENT DOCUMENTS

| | | | | |
|---|---|---|---|---|
| 4,399,712 | A * | 8/1983 | Oshikubo et al. | 73/864.16 |
| 4,519,258 | A | 5/1985 | Jakubowicz | 73/864.16 |
| 5,389,341 | A | 2/1995 | Tuunanen et al. | 422/100 |
| 5,505,097 | A * | 4/1996 | Suovaniemi et al. | 73/864.18 |
| 6,175,369 | B1 | 1/2001 | Dyer et al. | 345/433 |
| 6,299,841 | B1 * | 10/2001 | Rainin et al. | 422/100 |
| 6,715,369 | B2 * | 4/2004 | Baba et al. | 73/864.16 |
| 2002/0005075 | A1 | 1/2002 | Kriz et al. | |
| 2002/0020233 | A1 | 2/2002 | Baba et al. | |
| 2003/0074989 | A1 | 4/2003 | Magnussen, Jr. et al. | |
| 2004/0149052 | A1 | 8/2004 | Jagdhuber | |

FOREIGN PATENT DOCUMENTS

| | | | |
|---|---|---|---|
| DE | 31 36777 | A1 | 8/1982 |
| DE | 103 01 343 | A1 | 8/2004 |
| EP | 0576967 | A2 | 1/1994 |
| EP | 1439002 | A2 | 7/2004 |
| JP | 08-215584 | | 8/1996 |
| WO | 0157490 | A1 | 8/2001 |

* cited by examiner

*Primary Examiner*—Robert R Raevis
(74) *Attorney, Agent, or Firm*—Vidas, Arrett & Steinkraus, P.A.

(57) ABSTRACT

Pipette having an axially relocatable control button, a pressure sensor, which is integrated into the control button, a lifting rod, coupled with the control button and having a stopping bead, a hollow driving spindle, accommodating the lifting rod and being axially relocatable, a twisting lock, preventing the driving spindle from being twisted, a turnable driving nut having screw thread engagement with the driving spindle, an axial support of the driving nut, an electric driving motor with a motor shaft, a gear between the motor shaft and the driving nut, an electric power supply, an electric control system, connected to the pressure sensor, the electric driving motor and the electric power supply, which provides an electric voltage to the electric driving motor upon a push on the control button which is indicated by the pressure sensor, so that the motor relocates the driving spindle via the gear in the direction of a relocation of the control button by the push, the driving spindle taking the lifting rod along with it on its stopping bead, a plunger, coaxially displaceable with respect to the lifting rod, a cylinder, connected to an opening which leads outward and in which the plunger is sealingly guided, and a plunger spring loading the plunger in the direction of an end of the lifting rod.

16 Claims, 7 Drawing Sheets

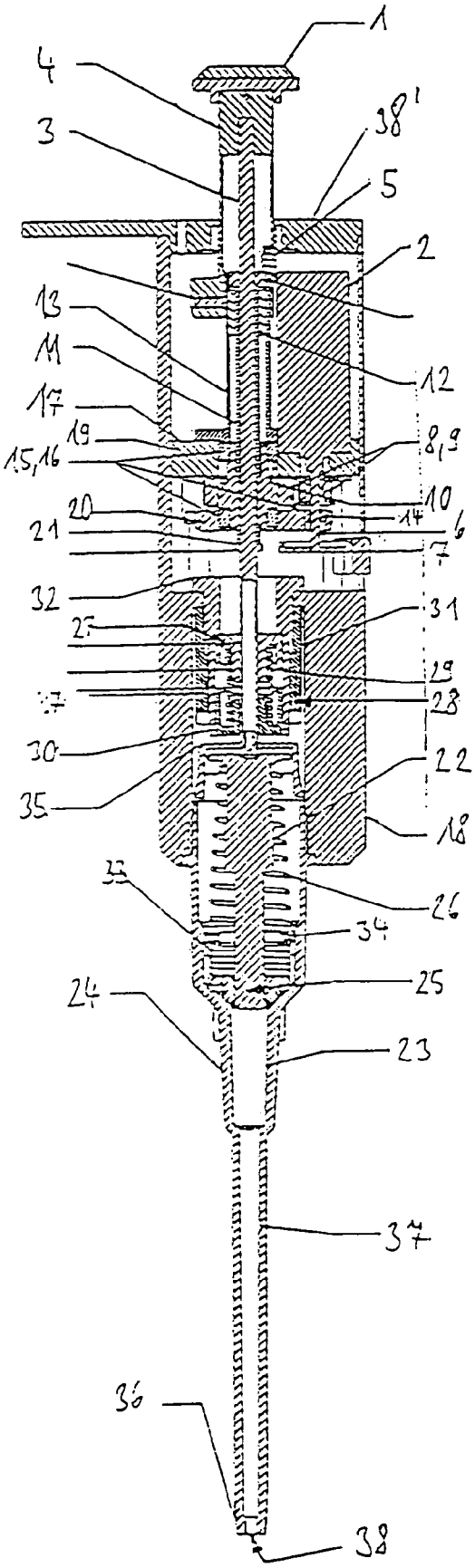
Fig. 1
Fig. 3
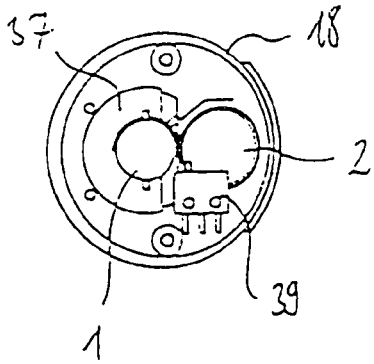

Function course in the pipetting mode

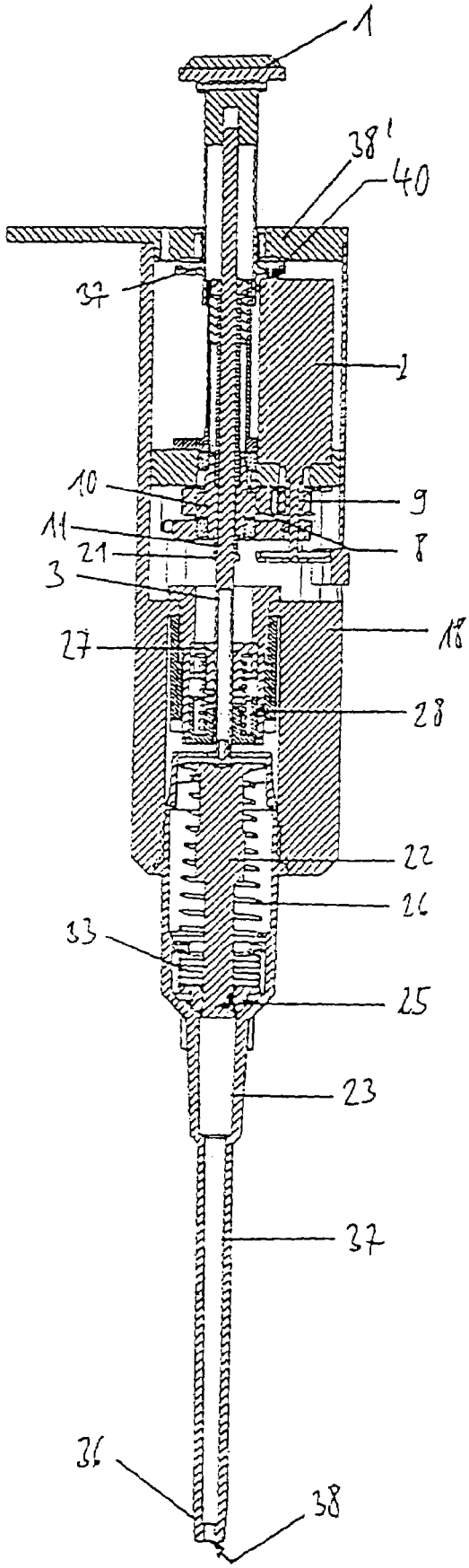
Fig. 5
Fig. 7
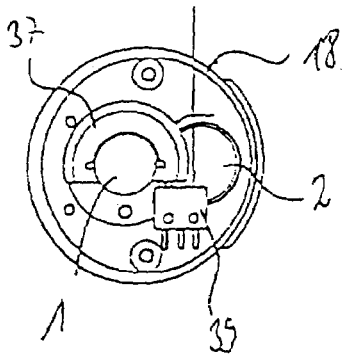

Function course in the dispensing mode

PIPETTE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

Pipettes are used in the laboratory for the dosage of liquids. They are known in different forms of realisation. Air cushion pipettes have an integrated cylinder with, a plunger arranged therein. The cylinder is connected to an opening in an attachment neck via a channel. A pipette point is detachably connectable with the attachment neck. Sample liquid is aspirated into the pipette point or ejected from it by displacing the plunger in the cylinder. In doing so, plunger and cylinder do not come into contact with the liquid, because the plunger moves the liquid indirectly via an air cushion. Only the pipette point, which is generally made of plastic material, is contaminated and can be exchanged after use.

Direct displacement pipettes are detachably connected to a syringe, the plunger of which is drivable through the pipette, in order to aspirate sample liquid directly into the syringe and to eject it out from the latter. Because the syringe is contaminated with the sample liquid, it can be replaced. The syringe is also generally made from plastic material.

When pipetting, the pipette gives off the liquid picked up by the point or syringe in one step. When dispensing, the liquid picked up by the syringe or point is given off in small partial amounts.

Pipettes with several channels have several channels by means of which dosage takes place simultaneously. Pipettes can be realised as hand-held devices and/or as stationary devices.

Manual pipettes have an actuation button, which is connected directly or via a gear with the plunger in a cylinder, or another displacement equipment for an air cushion or sample liquid. Working with manual pipettes is fatiguing. In electronic pipettes, an electric drive motor is coupled to a displacement equipment via a gear. The user controls the functions of electronic pipettes via key entry. As a consequence, working with electronic pipettes is less fatiguing. However, the operation needs acquaintance to be used by the user of manual pipettes. Particularly, there is no actuation of a control button which is synchronised with the movement of the displacement equipment.

Departing from this, the present invention has the objective to provide a pipette which makes possible a less fatiguing work, while the handling of a manual pipette is maintained as far as possible.

BRIEF SUMMARY OF THE INVENTION

The pipette according to the invention has an axially relocatable control button, a pressure sensor, which is integrated into the control button, a a lifting rod, coupled with the control button and having a stopping bead, a hollow driving spindle, accommodating the lifting rod and being axially relocatable, a twisting lock, preventing the driving spindle from being twisted, a turnable driving nut having screw thread engagement with the driving spindle, an axial support of the driving nut, an electric driving motor with a motor shaft, a gear between the motor shaft and the driving nut, an electric power supply, an electric control system, connected to the pressure sensor, the electric driving motor and the electric power supply, which provides an electric voltage to the electric driving motor upon a push on the control button which is indicated by the pressure sensor, so that the motor relocates the driving spindle via the gear in the direction of a relocation of the control button by the push, the driving spindle taking the lifting rod along with it on its stopping bead, a plunger, coaxially displaceable with respect to the lifting rod, a cylinder, connected to an opening which leads outward and in which the plunger is sealingly guided, and a plunger spring, loading the plunger in the direction of an end of the lifting rod.

In the pipette according to the invention, manual actuation of the control button causes an axial movement of the plunger, supported by the driving motor, namely, a servo-assisted plunger movement. This movement lasts as long as the user pushes on the button. As a consequence, the user still moves the plunger upon pipetting, dispensing or similar functions, but with a reduced effort. The backward movement of the plunger and the lifting rod is effected by the plunger spring, after relief of the control button by the user. In principle, the plunger spring can also cause the backward movement of the driving spindle. Preferably, the driving spindle is moved back by the electric control system through the application of an electric voltage to the electric driving motor, when the pressure sensor indicates relief of the control button. The operation of the pipette corresponds to that one of a conventional manual pipette, the effort required for the operation being similarly small as with an electronic pipette. As the plunger spring pushes the plunger against the end of the lifting rod, the pipette is clearance-free, and therefore it is not necessary that it performs a reverse stroke for clearance compensation.

The pipette may be realised for working in the pipetting mode only, or for working in the dispensing mode, or for working in both modes. In principle, the user can control pipetting and dispensing of liquids manually, by pushing and relieving the control button, so that the plunger covers defined distances. Preferably, the upward movements of the plunger in the pipetting or dispensing mode, respectively, are not manually terminated but electronically terminated.

According to one form of realisation, in the pipetting mode the electric control system, upon a push on the control button, which is indicated by the pressure sensor, relocates the driving spindle in the direction of the relocation of the control button through the push up to the stop situation of the stopping bead on a downside stop through the application of an electric voltage to the electric driving motor, the control system further relocates the driving spindle in the opposite direction up to a position corresponding to the pipetting volume by application of an electric voltage to the driving motor when the pressure sensor indicates relief of the control button, and the control system again relocates the driving spindle in the direction of the relocation of the control button through the push up to the stop situation of the stopping bead on the downside stop upon a further push on the control button, which is indicated by the pressure sensor, by application of an electric voltage to the electric driving motor. By the first push on the control button, the plunger is brought into its initial position for aspirating liquids, after relief of the control button the plunger aspirates liquid, and by the terminatory push on the control button, the liquid is ejected. The plunger strokes which are necessary for pipetting a defined pipetting volume are terminated by the electric control system.

Preferably, the movements of the plunger are electronically controlled in the dispensing mode. According to one form of realisation, the pipette has an equipment for locking the control button against any axial movement for this purpose. The control button serves only as a key head for the control of dispensing processes. According to a further form of realisation, the pipette has a switch, connected to the electric control system, for switching between a pipetting mode and a dispensing mode. According to a further form of realisation, the switch is coupled to the equipment for locking the control button, so that the dispensing mode is automatically switched on when the control button is locked. According to a further form of realisation, the equipment for locking has a spring element, which supports the control button in the axial direction against a push on the control button. Through this, the user does not push against a rigid stop. This is advantageous for the tactile sensation of the user.

According to one form of realisation, in the dispensing mode the electric control system relocates the driving spindle up to the stop situation of a stopping bead of the lifting rod on a downside stop through the application of an electric voltage to the electric driving motor, the electric control system, upon a push on the control button, which is indicated by the pressure sensor, relocates the driving spindle through the application of an electric voltage to the electric driving motor in the opposite direction, up to a position corresponding to the total volume to be dispensed, the control system relocates, upon a further push on the control button, which is indicated by the pressure sensor, the driving spindle through the application of an electric voltage to the electric driving motor in the direction of the downside stop up to a position corresponding to the individual dispensing volume, and repeats this, as the case may be, upon further pushes on the control button, which are indicated by the pressure sensor, until a predetermined number of dispensing steps has taken place. Working in the dispensing mode is controlled by the user just only by pushing on the control button. The plunger strokes which are necessary for dispensing defined dispensing volumina are controlled by the electric control system.

According to one form of realisation, the electric control system does not apply any electric voltage to the electric drive motor when the pressure sensor indicates a reduced push on the control button. This makes it possible for the user to stop the pipette by reducing the push on the control button.

According to one form of realisation, the pipette has a downside stop, co-operating with the stopping bead of the lifting rod and which is supported by a spring, and the electric control system further relocates the driving spindle in the direction of the downside stop through the application of an electric voltage to the electric driving motor, when the stopping bead is in the stop situation with respect to the downside stop, when there is a push on the control button, indicated by the pressure sensor, so that the stopping bead springably presses the downside stop together. This makes it possible to perform an overstroke of the plunger, which causes ejection of residual liquid, by bearing down the spring resistance.

In a simple form of realisation, the degree of overstroke and the return to the rebound condition of the downside stop is manually controlled. According to a further form of realisation, upon a push on the pressure sensor, the electric control system controls the process such that the stop is pressed together about a defined degree. According to a form of realisation which automatically controls the return to the rebound position, upon a relief of the control button, indicated by the pressure sensor, the electric control device relocates the driving spindle through application of an electric voltage on the driving motor, up to the point where the downside stop has reached the rebound position. Through this, the downside stop position is unambiguously recovered.

The pipette can be realised such that fixed volumina are pipetted or that they are dispensed in a predetermined number of steps. According to a form of realisation which enables adjusting the volumina to be pipetted or dispensed, respectively, and the number of dispensing steps, respectively, the electric control system is connected to at least one input element for inputting a pipetting volume and/or a dispensing volume and a number of dispensing steps.

According to a further form of realisation, the electric control system comprises a display unit for the display of selected volumina to be pipetted and/or volumina to be dispensed and of dispensing steps. The display unit may also be used for displaying the working condition of the pipette.

According to one form of realisation, the pipette has a detachably fixed downside part, in which the plunger and the cylinder are disposed. The downside part may be detached from the pipette for cleaning- and maintenance purposes, e.g.

According to a further form of realisation, the downside part has a shaft with the passage opening. The shaft may serve for fixing a pipette point, e.g.

According to a further form of realisation, the downside part is a syringe. The syringe can also be provided with a shaft for selectively picking up and releasing liquids. Finally, according to one form of realisation an angle encoder is disposed on the axis of the electric driving motor, which is connected to the electric control system. Through this, the movement of the electric driving motor is exactly controllable.

BRIEF DESCRIPTION OF SEVERAL VIEWS OF THE DRAWINGS

The invention will now be explained in more detail by means of the attached drawings of a realisation example. In the drawings show:

FIG. 1 the pipetting device in the upper pipetting position in a longitudinal section;

FIG. 3 the pipetting device in the pipetting mode in a cross section through the upper region of the casing;

FIG. 5 the pipetting device in the upper dispensing position in a longitudinal section;

FIG. 7 the pipetting device in the dosage mode in a cross section through the upper portion;

DETAILED DESCRIPTION OF THE INVENTION

Figure 2:
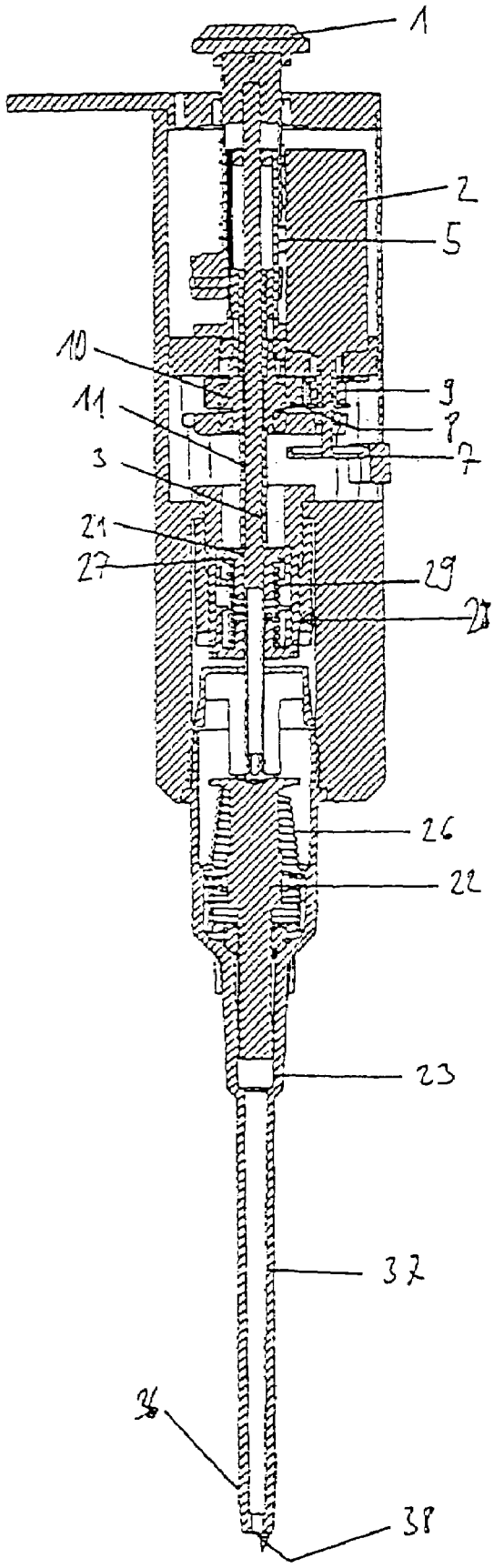
FIG. 2 the pipetting device in the lower pipetting position in a longitudinal section.

While this invention may be embodied in many different forms, there are described in detail herein a specific preferred embodiment of the invention. This description is an exemplification of the principles of the invention and is not intended to limit the invention to the particular embodiment illustrated In the following description, the indications "upper and "lower" or "upside" and "downside", respectively, are related to a substantially vertical orientation of the pipetting device, in which the control button is arranged upside and the pipette point is arranged downside, as is normally the case when liquid is picked up and given off.

The dosage equipment has a control button 1 with a not shown pressure sensor for simultaneous control of a driving motor 2 and of a lifting rod 3. The control button 1 has a button lower portion 4. The button lower portion 4 and the lifting rod 3 are loosely guided into one another and are kept in permanent bearing by a clearance compensation spring 5.

An user controls the downside movement of the lifting rod 3 by pressing on the control button 1.

On a shaft 6 of the driving motor 2, an angle encoder 7 is attached. The shaft 6 is coupled with a driving nut 10 via driving pulleys 8, 9 and a not shown driving belt. The driving nut 10 is in screw thread engagement with a driving spindle 11 and drives the driving spindle 11 in the axial direction. Any twisting of the driving spindle 11 is prevented by a twisting lock 12 for the driving spindle 11. The twisting lock 12 co-operates with a guiding sleeve 13. The twisting lock 12 is formed by a polygon element, seated on the driving spindle 11, which is guided in a receptacle of the guiding sleeve 13 with a corresponding profile.

The driving motor 2, a bearing 14 bearing the shaft 6, the angle encoder 7, the driving pulleys 8, 9, the driving nut 10, the guiding sleeve 13, driving bearings 15, 16 bearing the driving nut 10 and the driving spindle 11 are mounted on a drive support 17, which is fixed in a casing 18. The drive support 17 has two parallel plates 19, 20, which are kept in a distance, between which the driving pulleys 8, 9 and the driving nut 10 are arranged.

The lower side of the driving spindle 11 co-operates with a stopping bead 21 of the lifting rod 3 and limits the stroke of the lifting rod 3 towards the upside. The driving motor 2 begins to run when the laboratory person actuates the control button 1 with the pressure sensor. As a consequence, the axial movement of the driving spindle 11 supports the movement of the lifting rod 3 towards the downside, which is manually controlled by the user.

The lifting rod 3 lies in close contact against a plunger 22, which is movably disposed inside a cylinder 23, which is present in a downside portion 24 of the dosage unit. The plunger 22 and the cylinder 23 are parts of a displacement equipment 25.

The lifting rod 3 and the plunger 22 are not connected with each other. The plunger 22 is only pushed upward by a plunger spring 26 into the stop position to the downside end of the lifting rod 3.

When the lifting rod 3 is pushed downward along a defined stroke, the stopping bead 21 hits a lower stop 27. The lower stop 27 is a part of an overstroke system 28, which comprises an overstroke spring 29, a screw 30 and a nut 31. The lower stop is axially downward-movably disposed in a receptacle of a support 32. The screw 30 is screwed into the receptacle from the downside. The overstroke spring 29 is clamped between the lower stop 27 and the screw 30. The support 32 is fixed on a nose in the casing 18 by means of a flange which exists on its upper edge and of the nut 31, which is screwed onto the support 32.

The lifting rod 3 can be moved downward about one further overstroke against the action of the overstroke spring 29.

The downside part 24 of the dosage equipment comprises a sealing system 33 for sealingly introducing the plunger 22 into the upper opening of the cylinder 23, the plunger 22, the plunger spring 26, which is supported in the downside part 24 and a cone 36 for putting on a pipette point. The cylinder 23 is connected to an opening 38 in the lower end of the cone 36 via a channel 37. The downside part 24 is a unit which is detachable connected with the casing 18, particularly for the purpose of cleaning the dosage equipment.

The basis position of the dosage equipment in the pipetting mode and at similar functions (mixing, reverse pipetting etc.) is shown in FIG. 1. The position of the plunger 22 corresponds to the volume of the liquid which is to be pipetted. After selection of this volume by the laboratory person, the driving motor 2 moves the driving spindle 11 and the plunger 22 in that position. The lifting rod 3 is permanently pressed into contact against the downside button part 4 of the control button 1 by the clearance compensation spring 5. As the plunger spring 26 is stronger than the clearance compensation spring 5, the plunger 22 pushes the lifting rod 3 upward until the stopping bead 21 of the lifting rod 3 sits close to the lower side of the driving spindle 11.

By pushing the control button 1, the laboratory person moves downward the lifting rod 3 and the plunger 22. The plunger 22 displaces an air column inside the downside part 24, which on its part displaces air or liquid from a pipette point which is fixed on the working cone 36. At the same time, the pressure sensor measures the force which is exerted on the control button 1 by the user, and a not shown microprocessor starts the driving motor 2. The position of the shaft 6 is detected by means of the angle encoder 7. The microprocessor evaluates the signals of the angle decoder 7 and includes the position of the shaft 6 into the control of the driving motor 2. The driving motor 2 moves the driving spindle 11 axially downward. The driving spindle 11 pushes downward the stopping bead 21 of the lifting rod 3, through which the force that has to be exerted by the user in order to push the control button downward is diminished. Thus, the manual dosage equipment has a servo drive.

When the stopping bead 21 reaches the downside stop 27, the user perceives this through an increase of the resistance. When the user stops the actuation of the control button 1, the driving motor 2 also stops. Depending on the decision of the user, an overstroke is then performed or it is not performed. To perform an overstroke, the user pushes the control button 1 again. The movement of the lifting rod 3 which takes place as a consequence of this is again supported by the driving motor 2. At the end of the overstroke, the driving spindle 11 and the plunger 22 have reached their lower position, as is shown in FIG. 2.

For pipetting a selected volume of a liquid, the plunger 22 is first moved downward, until the stopping bead 21 hits the downside stop 27. Thereafter, the pipette point is dipped into the liquid. After relief of the control button 1, the driving spindle runs back, and the plunger spring 26 pushes the plunger 22 upward, until the stopping bead 21 hits against the lower side of the driving spindle 11. During the upward movement of the plunger 22, the selected volume of the liquid is aspirated into the pipette point. In order to eject the liquid from the pipette point, the control button 1 is actuated again, until the stopping bead 21 hits against the downside stop 27. An overstroke is performed for removal of residual amounts of the liquid from the pipette point.

Figure 4:
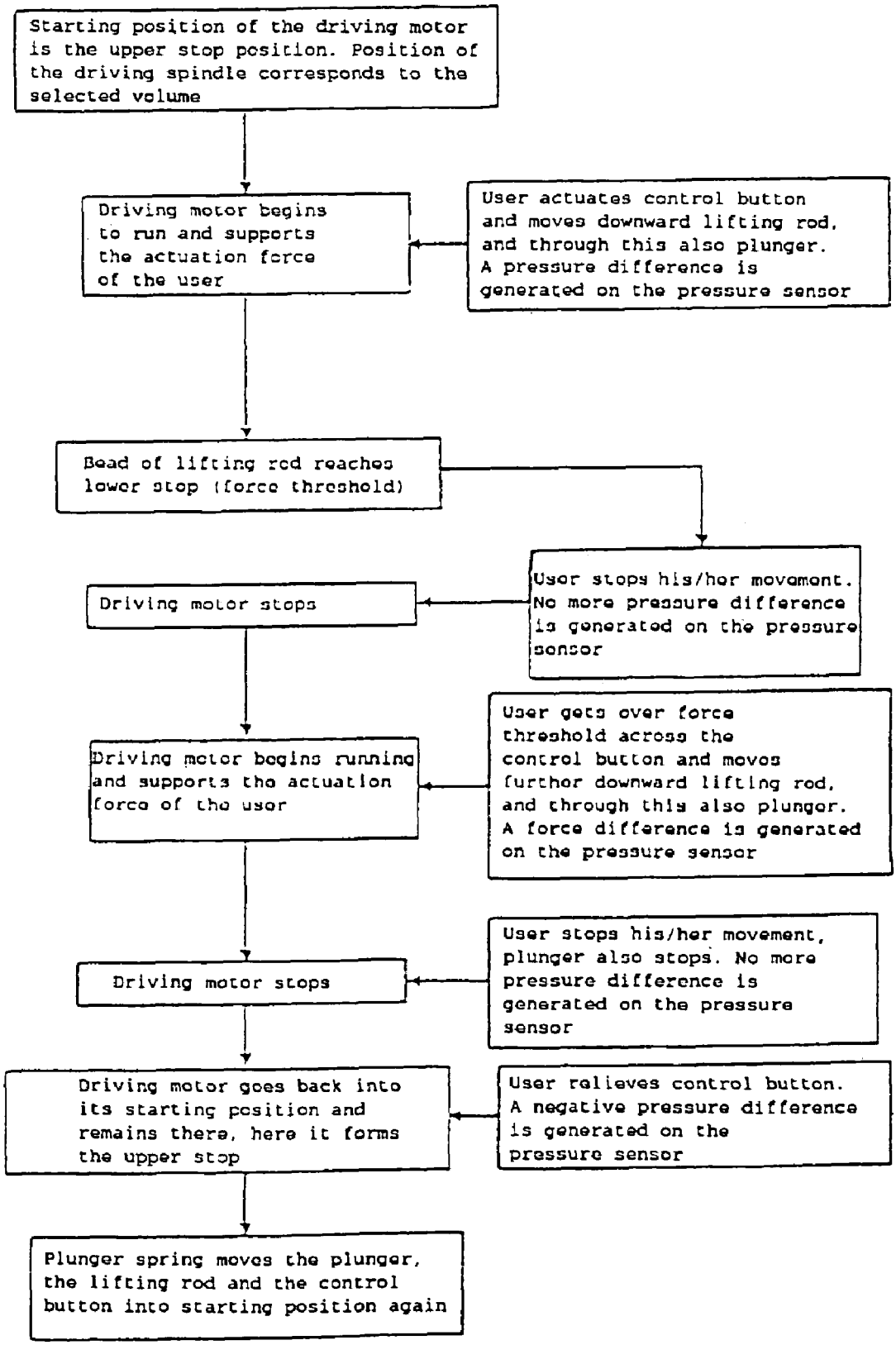
FIG. 4 function course in the pipetting mode in a block diagram.

The function course in the pipetting mode is resumed in the FIG. 4. With respect to the actuations of the pressure sensor by the user, it is assumed in the block diagram that these are recognised by means of pressure differences which are detectable in the course of time. This will still be explained by means of FIG. 9.

Figure 6:
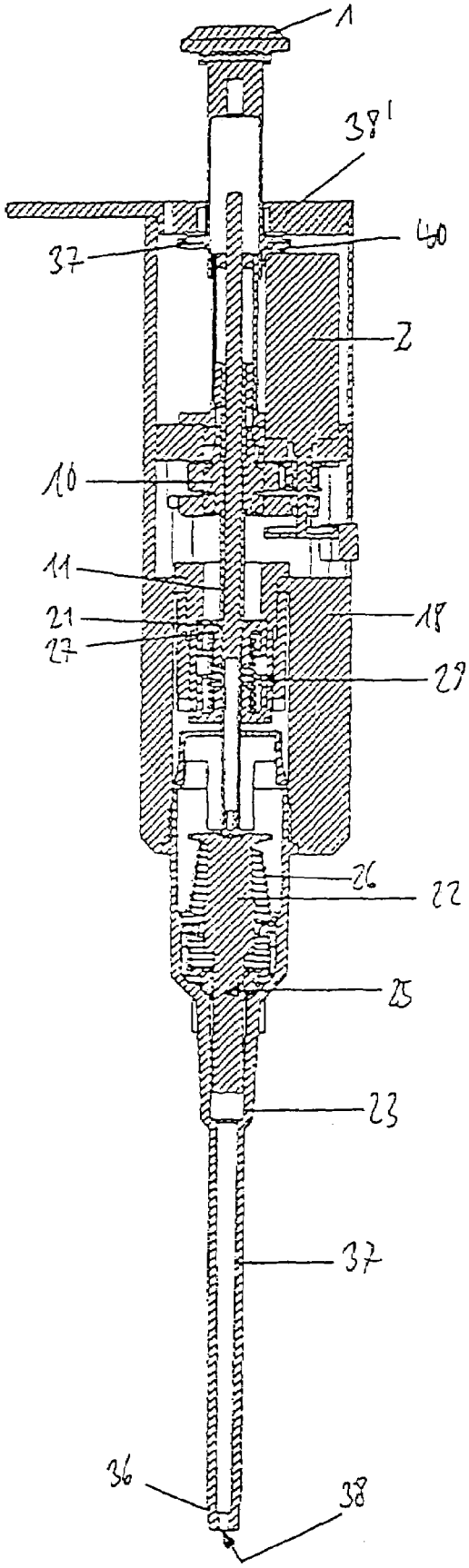
FIG. 6 the pipetting device in the lower dispensing position in a longitudinal section.

In order to switch over into the dispensing mode, the user has to pull the control button 1 with the downside button part 4 with a circular disc segment 37, which is fixed on the lower end, against a cover 38' of the casing 18 and twist the downside button part4 about a certain angle. By this rotation, the control button is locked against any axial relocation, because the circular disc segment 37 is caught between the cover 38' and the upper side of the driving motor 2. A microswitch 37, signals to the microcomputer that the dispensing mode is switched on. The driving motor 2 moves the driving spindle 11 and the lifting rod 3 with the stopping bead 21 against the downside stop 27. Thus, the plunger 22 is in the picking up position, as is shown in FIG. 6. In FIG. 3, the control button is shown in the pipetting mode, and in FIG. 7 it is shown in the dispensing mode after being turned.

After locking, according to FIG. 5 a spring element 40 enables a small residual stroke, which serves for the tactile perception of the laboratory person. In the dispensing mode, the control button 1 serves only as a switch. In the dispensing mode, the lifting rod 3 is moved downward only by the driving spindle 11, and is moved upward by the plunger spring 26.

After the user has selected the dispensing volume and the number of dispensing steps, the microprocessor calculates the total volume that is to be picked up.

When the control button 1 is pressed again, the driving motor 2 moves the driving spindle 11 into the position which corresponds to the total volume to be picked up, plus a surplus volume. The plunger 22 is pushed upward by the plunger spring 26, and the dosage equipment picks up the total volume.

When the control button 1 is pressed again, the driving motor 2 moves downward the driving spindle 11, through which the stopping bead 21, the lifting rod 3 and the plunger 22 are moved downward. The driving motor 2 stops, when the position corresponding to the first dispensing volume has been reached. During the downward movement, the first dispensing volume is ejected out of the pipette point.

This procedure is repeated upon each actuation of the control button 1, until the total dispensing volume is dispensed or given off, respectively.

When the total dispensing volume is given off, the second next actuation of the control button 1 triggers the overstroke, through which the residual liquid is ejected out of the pipette point.

After the overstroke, the driving motor 2 moves the driving spindle 11 and the plunger spring 26 moves the plunger automatically back into the picking up position according to FIG. 6. The system is then ready for a new dispensing sequence.

Figure 8:
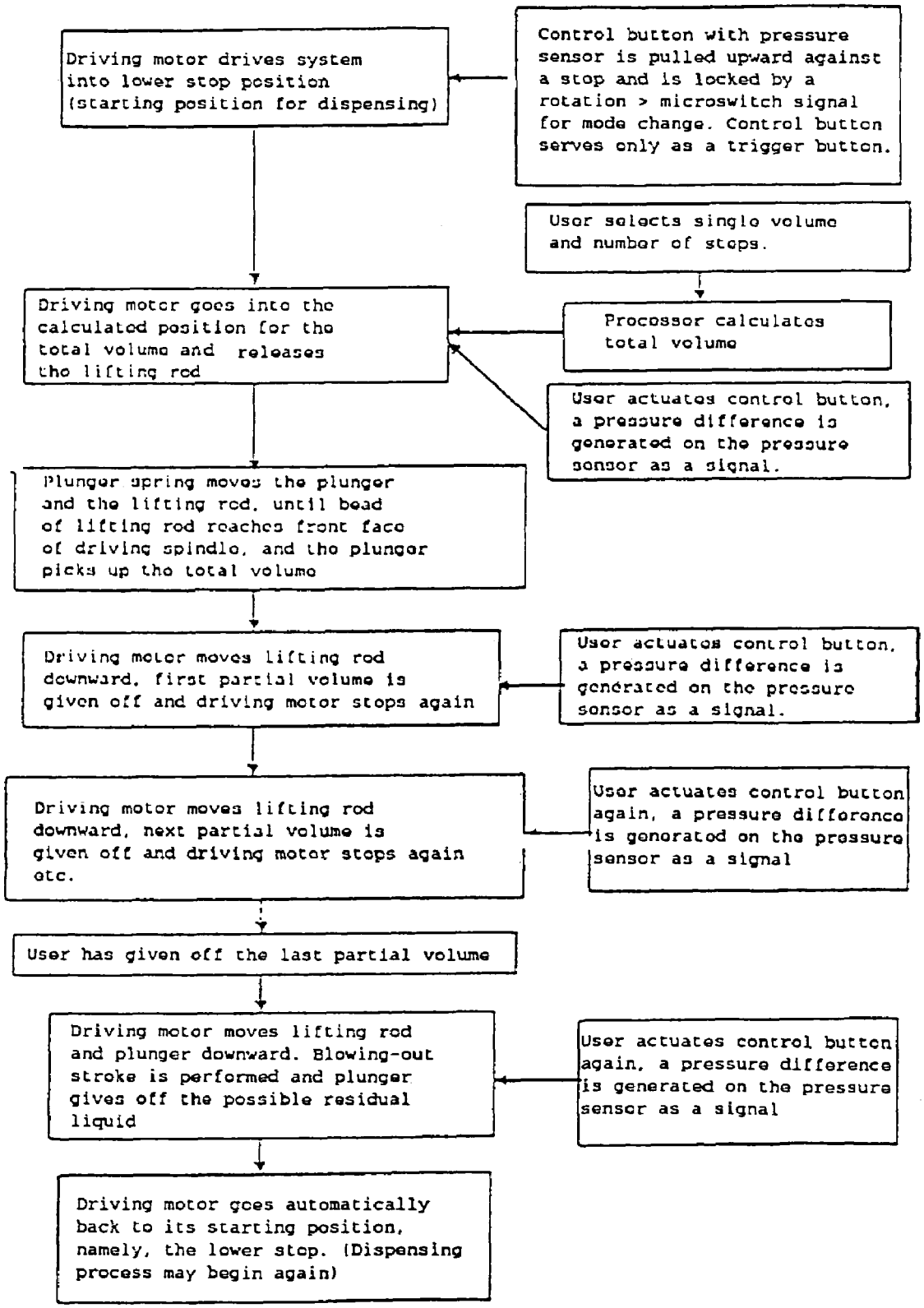
FIG. 8 function course in the dispensing mode in a block diagram.

The function course in the dispensing mode is resumed in FIG. 8. As for the actuation of the pressure sensor by the user, it is assumed in the block diagram that the former is recognised by means of pressure differences which are detectable in the course of time. This is explained below by means of the FIG. 9.

Figure 9:
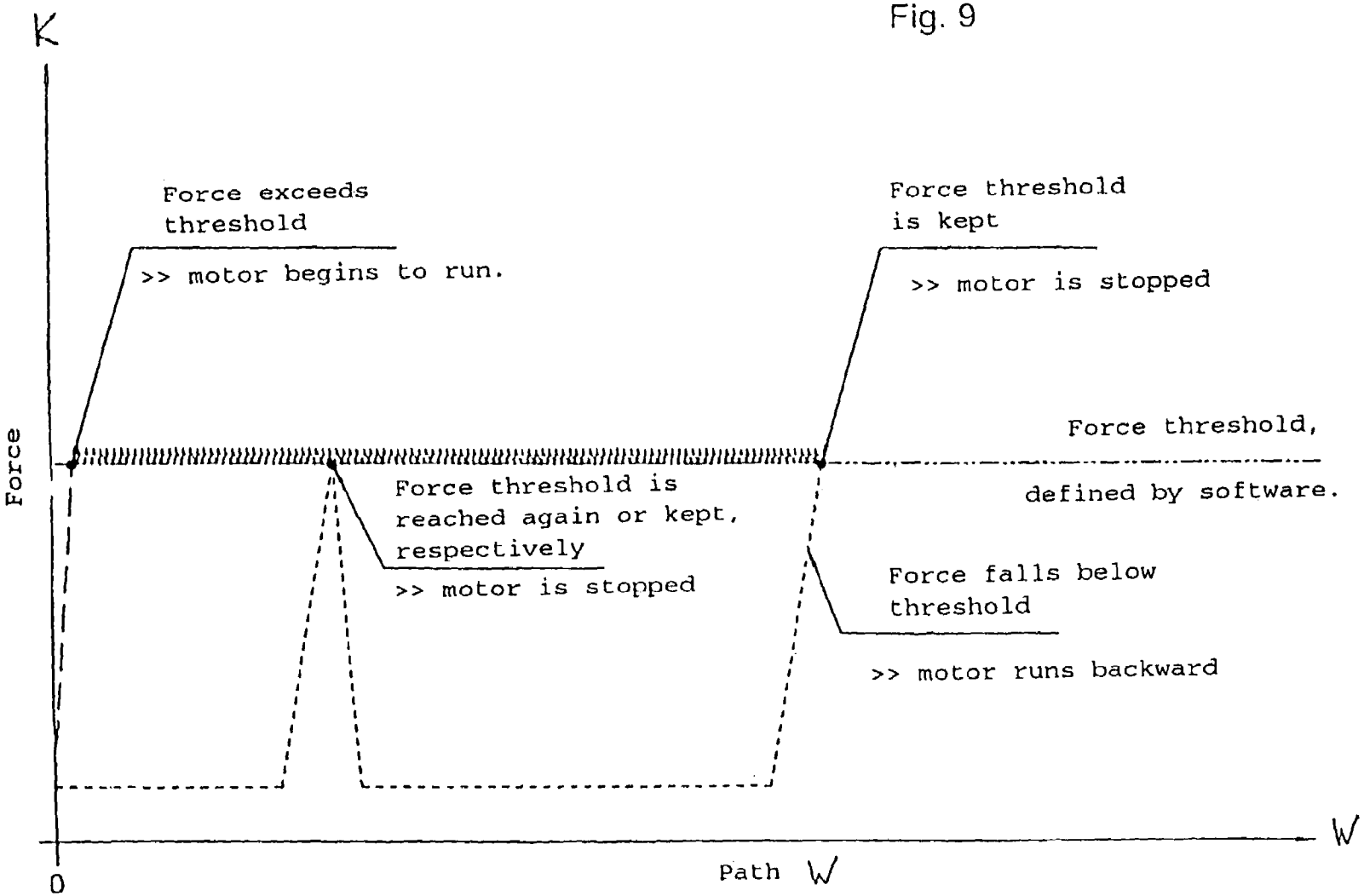
FIG. 9 course of the force K, exerted by a push on the pressure sensor, along the path W, which is covered by the plunger, in a schematic diagram.

According to FIG. 9, the driving motor 2 drives the lifting rod 3 when the user pushes on the control button 1. As the servo motor relieves the control button 1, the user has to "push after", in order to ensure further propulsion through the driving motor 2. This results in a saw tooth shaped course of the force around a force threshold, at which the movement of the plunger 22 is supported by the electric drive motor 2. As a result of this saw tooth shaped course, temporal pressure differences are generated, which are detected by the electric control system and are used for the switching on of the electric driving motor.

At the end of the propulsion movement, when the driving spindle 11 hits the stop 27, the force exerted by the user on the control button 1 is a constant one. As a consequence, the electric driving motor 2 is switched off.

When the user relieves the control button 1, the force falls below the threshold, and this is also detected by the electronic control system. As a consequence, the electric driving motor 2 is driven in the opposite direction and the driving spindle 11 goes upward.

Further, it is shown in the diagram that the electric driving motor 2 can be stopped or driven back at any point in time.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. Pipette having an axially relocatable control button (1), a pressure sensor, which is integrated into the control button (1), a lifting rod (3), coupled with the control button (1) and having a stopping bead (21), a hollow driving spindle (11), accommodating the lifting rod (3) and being axially relocatable, a twisting lock (13), preventing the driving spindle (11) from being twisted, a turnable driving nut (10) having screw thread engagement with the driving spindle (11), an axial support of the driving nut (10), an electric driving motor (2) with a motor shaft (6), a gear (8,9) between the motor shaft (6) and the driving nut (2), an electric power supply, an electric control system, connected to the pressure sensor, the electric driving motor (2) and the electric power supply, which provides an electric voltage to the electric driving motor (2) upon a push on the control button (1) which is indicated by the pressure sensor, so that the motor relocates the driving spindle (11) via the gear (8, 9) in the direction of a relocation of the control button (1) by the push, the driving spindle (11) taking the lifting rod (3) along with it on its stopping bead (21), a plunger (22), coaxially displaceable with respect to the lifting rod (3), a cylinder (23), connected to an opening (38) which leads outward and in which the plunger (22) is sealingly guided, and a plunger spring (26), loading the plunger (22) in the direction of an end of the lifting rod.

2. Pipette according to claim 1, wherein in the pipetting mode the electric control system, upon a push on the control button (1), which is indicated by the pressure sensor, relocates the driving spindle (11) in the direction of the relocation of the control button (1) through the push up to the stop situation of the stopping bead (21) on a downside stop (27) through the application of an electric voltage to the electric driving motor (2), the control system relocates the driving spindle (11) in the opposite direction up to a position corresponding to the pipetting volume by application of an electric voltage to the driving motor (2) when the pressure sensor indicates relief of the control button (11), and the control system again relocates the driving spindle (11) in the direction of the relocation of the control button (1) through the push up to the stop situation of the stopping bead (21) on the downside stop (27) upon a further push on the control button (1), which is indicated by the pressure sensor, by application of an electric voltage to the electric driving motor (2).

3. Pipette according to claim 2, wherein the electric control system does not apply any electric voltage to the electric drive motor (2) when the pressure sensor indicates a reduced push on the control button 1.

4. Pipette according to claim 3, which has a downside stop (27) co-operating with a stopping bead (21) of the lifting rod (3) and which is supported by a spring, and wherein the electric control system further relocates the driving spindle in the direction of the downside stop (27) through the application of an electric voltage to the electric driving motor (2), when the stopping bead is in the stop situation with respect to the downside stop, when there is a push on the control button (1), indicated by the pressure sensor, so that the stopping bead (21) springably presses the downside stop (27) together

5. Pipette according to claim 4, wherein upon a relief of the control button (1), indicated by the pressure sensor, the electric control device relocates the driving spindle (11) in the opposite direction through application of an electric voltage on the driving motor (2), up to the point where the downside stop (27) has reached the rebound position.

6. Pipette according to claim 1, which has an equipment for locking (37) the control button (1) against any axial movement.

7. Pipette according to claim 6, which has a switch (39), connected to the electric control system, for switching between a pipetting mode and a dispensing mode.

8. Pipette according to claim 7, in which the switch (39) is coupled to the equipment for locking (37) the control button (1).

9. Pipette according to claim 7, wherein in the dispensing mode the electric control system relocates the driving spindle (11) up to the stop situation of a stopping bead (21) of the lifting rod (3) on a downside stop through the application of an electric voltage to the electric driving motor (2), the electric control system, upon a push on the control button (1), which is indicated by the pressure sensor, relocates the driving spindle (11) through the application of an electric voltage to the electric driving motor (2) in the opposite direction, up to a position corresponding to the total volume to be dispensed, the control system relocates, upon a further push on the control button (1), which is indicated by the pressure sensor, the driving spindle (11) through the application of an electric voltage to the electric driving motor (2) in the direction of the downside stop (27) up to a position corresponding to the individual dispensing volume, and repeats this, as the case may be, upon further pushes on the control button (1), which are indicated by the pressure sensor, until a predetermined number of dispensing steps has taken place.

10. Pipette according to claim 6, wherein the equipment for locking (37) has a spring element (40) which supports the control button (1) in the axial direction against a push on the control button.

11. Pipette according to claim 1, which has at least one input element, connected to the electric control system, for inputting a pipetting volume and/or a dispensing volume and a number of dispensing steps.

12. Pipette according to claim 1, wherein the electric control system comprises a display unit.

13. Pipette according to claim 1, which has a detachably fixed downside part (24), in which the plunger (22) and the cylinder (23) are disposed.

14. Pipette according to claim 13, wherein the downside part (24) has a shaft with the opening (38).

15. Pipette according to claim 13, wherein the downside part (24) is a syringe.

16. Pipette according to claim 1, wherein an angle encoder (7) is disposed on the axis of the electric driving motor (2), which is connected to the electric control system.

* * * * *